United States Patent [19]

Anderson et al.

[11] 3,994,340

[45] Nov. 30, 1976

[54] METHOD OF RECOVERING VISCOUS PETROLEUM FROM TAR SAND

[75] Inventors: Donald J. Anderson, Newport Beach, Calif.; Charles F. Kirkvold; Peter Pisio, both of Calgary, Canada

[73] Assignee: Chevron Research Company, San Francisco, Calif.

[22] Filed: Oct. 30, 1975

[21] Appl. No.: 627,305

[52] U.S. Cl. ..... 166/272; 166/50; 166/57

[51] Int. Cl.[2] ..... E21B 43/24

[58] Field of Search ..... 166/272, 302, 303, 57, 166/50; 299/2, 4, 6

[56] References Cited

UNITED STATES PATENTS

| | | | |
|---|---|---|---|
| 1,634,235 | 6/1927 | Ranney | 299/2 |
| 1,634,236 | 6/1927 | Ranney | 299/2 |
| 2,786,660 | 3/1957 | Alleman | 299/6 |
| 2,980,184 | 4/1961 | Reed | 166/303 |
| 3,024,013 | 3/1962 | Rogers et al. | 166/302 |
| 3,205,012 | 9/1965 | Dancy | 299/2 |
| 3,338,306 | 8/1967 | Cook | 166/302 |
| 3,386,508 | 6/1968 | Bielstein et al. | 166/272 |
| 3,881,551 | 5/1975 | Terry et al. | 166/272 |

*Primary Examiner*—Stephen J. Novosad
*Assistant Examiner*—George A. Suckfield
*Attorney, Agent, or Firm*—R. L. Freeland, Jr.; Edward J. Keeling

[57] ABSTRACT

Recovery of viscous petroleum such as from tar sands is assisted using a substantially vertical passage from the earth's surface which penetrates the tar sand and has extending therefrom a lateral hole containing a flow path isolated from the tar sand for circulating a hot fluid to and from the vertical passage to develop a potential flow path into which a drive fluid is injected to promote movement of the petroleum to a production position.

16 Claims, 7 Drawing Figures

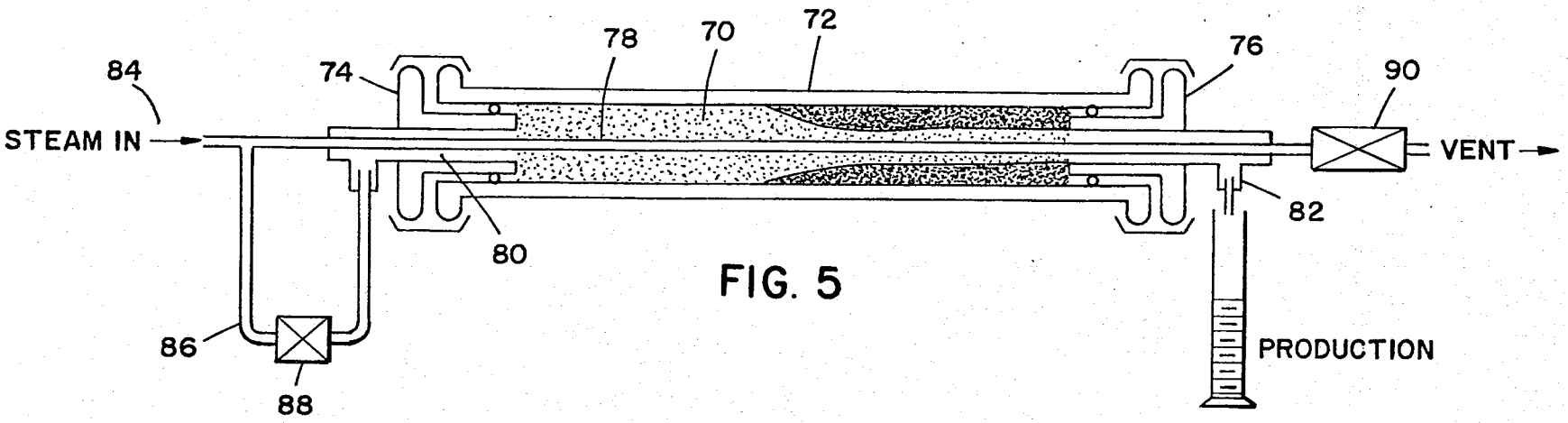
FIG. 5
RESIDUAL PETROLEUM WT %
| CORE POSITION | | PLANE A | B | C | D | E | F |
|---|---|---|---|---|---|---|---|
| LEFT SIDE | 1 | 3.8 | 5.5 | 5.9 | 6.5 | 8.2 | 7.2 |
| | 2 | 3.7 | 4.4 | 5.4 | 4.3 | 7.3 | 5.7 |
| | 3 | 3.9 | 4.2 | 5.2 | 5.7 | 4.6 | 7.9 |
| CENTER LINE | 4 | 3.7 | 4.4 | 5.2 | 4.9 | 8.8 | 9.0 |
| | 5 | 3.7 | 4.8 | 3.7 | 4.3 | 7.3 | 7.1 |
| | 6 | 3.7 | 3.9 | 4.1 | 4.2 | 6.7 | 5.4 |
| | 7 | 3.8 | 4.7 | 4.0 | 5.0 | 4.5 | 4.9 |
| RIGHT SIDE | 8 | 4.2 | 5.2 | 6.0 | 6.4 | 10.9 | 9.5 |
| | 9 | 3.8 | 4.4 | 5.8 | 4.5 | 7.0 | 7.3 |
| | 10 | 3.9 | 4.2 | 5.8 | 4.3 | 6.0 | 6.2 |
| | 11 | 4.1 | 5.1 | 7.1 | 5.4 | 5.2 | 5.8 |
FIG. 7
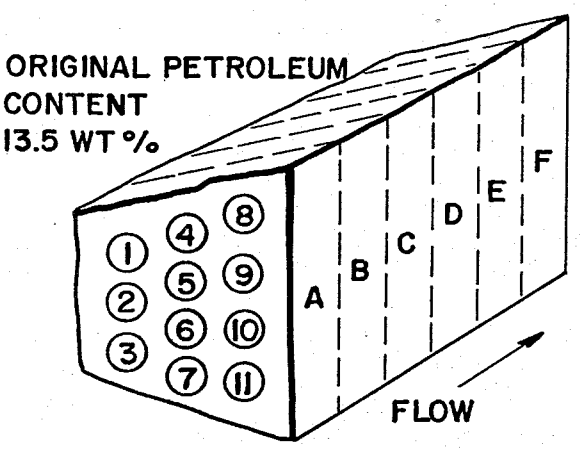
FIG. 6

METHOD OF RECOVERING VISCOUS PETROLEUM FROM TAR SAND

CROSS REFERENCE TO RELATED APPLICATIONS

This application is related to application Ser. No. 627,304, filed Oct. 30, 1975, for "Method of Recovering Viscous Petroleum from an Underground Formation," application Ser. No. 627,306, filed Oct. 30, 1975, for "Recovering Viscous Petroleum from Thick Tar Sand," application Ser. No. 643,579, filed Dec. 22, 1975, for "System for Recovering Viscous Petroleum from Thick Tar Sand," application Ser. No. 643,580, filed Dec. 22, 1975, for "Method of Recovering Viscous Petroleum from Thick Tar Sand," and application Ser. No. 650,571, filed Jan. 19, 1976, for "Arrangement for Recovering Viscous Petroleum from Thick Tar Sand".

BACKGROUND OF THE INVENTION

This invention relates generally to recovering viscous petroleum from petroleum-containing formations. Throughout the world there are several major deposits of high-viscosity crude petroleum in oil sand not recoverable in their natural state through a well by ordinary production methods. In the United States, the major concentration of such deposits is in Utah, where approximately 26 billion barrels of in-place heavy oil or tar exists. In California, the estimate of in-place heavy oil or viscous crude is 220 million barrels. By far the largest deposits in the world are in the Province of Alberta, Canada, and represent a total in-place resource of almost 1000 billion barrels. The depths range from surface outcroppings to about 2000 feet.

To date, none of these deposits has been produced commercially by an in-situ technology. Only one commercial mining operation exists, and that is in a shallow Athabasca deposit. A second mining project is about 20% completed at the present time. However, there have been many in-situ well-to-well pilots, all of which used some form of thermal recovery after establishing communication between injector and producer. Normally such communication has been established by introducing a pancake fracture. The displacing or drive mechanism has been steam and combustion, such as the project at Gregoire Lake or steam and chemicals such as the early work on Lease 13 of the Athabasca deposit. Another means of developing communication is that proposed for the Peace River project. It is expected to develop well-to-well communication by injecting steam over a period of several years into an aquifer underlying the tar sand deposit at a depth of around 1800 feet Probably the most active in-situ pilot in the oil sands has been that at Cold Lake. This project uses the huff-and-puff single-well method of steam stimulation and has been producing about 4000 barrels of viscous petroleum per day for several years from about 50 wells. This is probably a semi-commercial process, but whether it is a paying proposition is unknown.

The most difficult problem in any in-situ well-to-well viscous petroleum project is establishing and maintaining communication between injector and producer. In shallow deposits, fracturing to the surface has occurred in a number of pilots so that satisfactory drive pressure could not be maintained. In many cases, problems arise from healing of the fracture when the viscous petroleum that had been mobilized through heat cooled as it moved toward the producer. The cool petroleum is essentially immobile, since its viscosity in the Athabasca deposits, for example, is on the order of 100,000 to 1 million cp at reservoir temperature.

As noted, the major problem of the economic recovery from many formations has been establishing and maintaining communication between an injection position and a recovery position in the viscous oil-containing formation. This is primarily due to the character of the formations, where fluids may be extremely low, and in some cases, such as the Athabasca Tar Sands, vitually nil. Thus, the Athabasca Tar Sands, for example, are strip mined where the overburden is limited. In some tar sands, hydraulically fracturing has been used to establish commuication between injectors and producers. This has not met with uniform success. A particularly difficult situation develops in the intermediate overburden depths, which cannot stand fracturing pressure.

Heretofore, many processes have been utilized in attempting to recover viscous petroleum from viscous oil formations of the Athabasca Tar Sands type. The application of heat to such viscous petroleum formations by steam or underground combustion has been attempted. The use of slotted liners positioned in the viscous oil formation as a conduit for hot fluids has also been suggested. However, these methods have not been overly successful because of the difficulty of establishing and maintaining communication between the injector and the producer.

BRIEF DESCRIPTION OF THE INVENTION

The present invention is directed to a method of assisting the recovery of viscous petroleum from a petroleum-containing formation and is particularly useful in those formations where communication between an injector and a producer is difficult to establish and maintain. A substantially vertical passage such as a well or a shaft is made from the earth's surface through the petroleum-containing formation. At least one laterally extending, usually substantially horizontal hole is extended from the vertical passage through at least a portion of the formation. A flow path is formed in the hole and the flow path is isolated from the formation for flow of fluid through the formation into and out of the vertical passage. A hot fluid is circulated through the flow path to reduce the viscosity of the viscous petroleum in the formation adjacent the outside of the flow path to form a potential passageway for flow of petroleum in the formation outside the flow path. A drive fluid is injected into the formation through the passageway to promote flow of petroleum in the formation to a recovery position for recovery from the formation. In preferred form, the hot fluid is steam and the drive fluid is also steam. The hot fluid and the drive fluid may be injected simultaneously under certain conditions. Under other conditions, the hot fluid and the drive fluid are injected intermittently or alternatively. The injectivity of the drive fluid into the formation is controlled by adjusting the flow of hot fluid through the flow path. In one aspect, the petroleum recovery position is a well penetrating the petroleum-containing formation in close proximity to the flow path and the drive fluid is injected into the formation through the vertical passage. In another aspect, the petroleum recovery position is located in the vertical passage and the drive fluid is injected into the formation through a well penetrating the petroleum-containing formation in close proximity to the flow path.

In a more particular form, the method of the invention deals with a method for recovering viscous petroleum from a petroleum-containing formation of the Athabasca type by providing a substantially vertical passage from the earth's surface through the formation and extending at least one substantially horizontal hole from the vertical passage through at least a portion of the formation. A solid-wall, hollow tubular member having a closed outer end is inserted into the horizontal hole and a flow pipe is inserted into the hollow tubular member to a position near the closed end of the tubular member to provide a flow path from the vertical passage through the horizontal hole into and out of the formation through the interior of the flow pipe and the space between the exterior of the flow pipe and the interior of the tubular member. A hot fluid is circulated through the flow path to reduce the viscosity of the viscous petroleum in the formation adjacent the outside of the tubular member to form a potential passageway for flow of petroleum in the formation outside the tubular member. A drive fluid is forced into the formation through the passageway to promote flow of petroleum adjacent the outside of the tubular member to a position for recovery from the formation. As noted, the preferred hot fluid is steam, although other fluids may be used. Steam also is preferred for use as a drive fluid. In some situations, other fluids such as gas or water may be useful drive fluids.

OBJECT OF THE INVENTION

The principal object of the present invention is to maximize recovery of viscous petroleum from a petroleum-containing formation wherein communication between an injector position and a producer position is difficult to establish and maintain by utilizing a hot fluid circulating laterally from a single well in a physically separated flow path through the formation to assist in establishing and maintaining communication for a drive fluid used to promote movement of the petroleum to the producer. Further objects and advantages of the present invention will become apparent when the description is read in view of the accompanying drawings which are made a part of this specification.

BRIEF DESCRIPTION OF THE DRAWINGS

FIG. 5 is an elevation view partially in section and illustrates apparatus used in conducting demonstrations in accordance with the present invention;

FIG. 6 is a perspective view of a block of tar sand flooded in accordance with the present invention showing position of core samples taken after the flood; and FIG. 7 is a table illustrating the analysis of such cores.

Clearly, if one could establish and maintain communication between injector and producer, regardless of the drive fluid or recovery technique employed, it would open up many of these viscous petroleum deposits to a number of potentially successful projects.

DETAILED DESCRIPTION OF THE INVENTION

Figure 1:
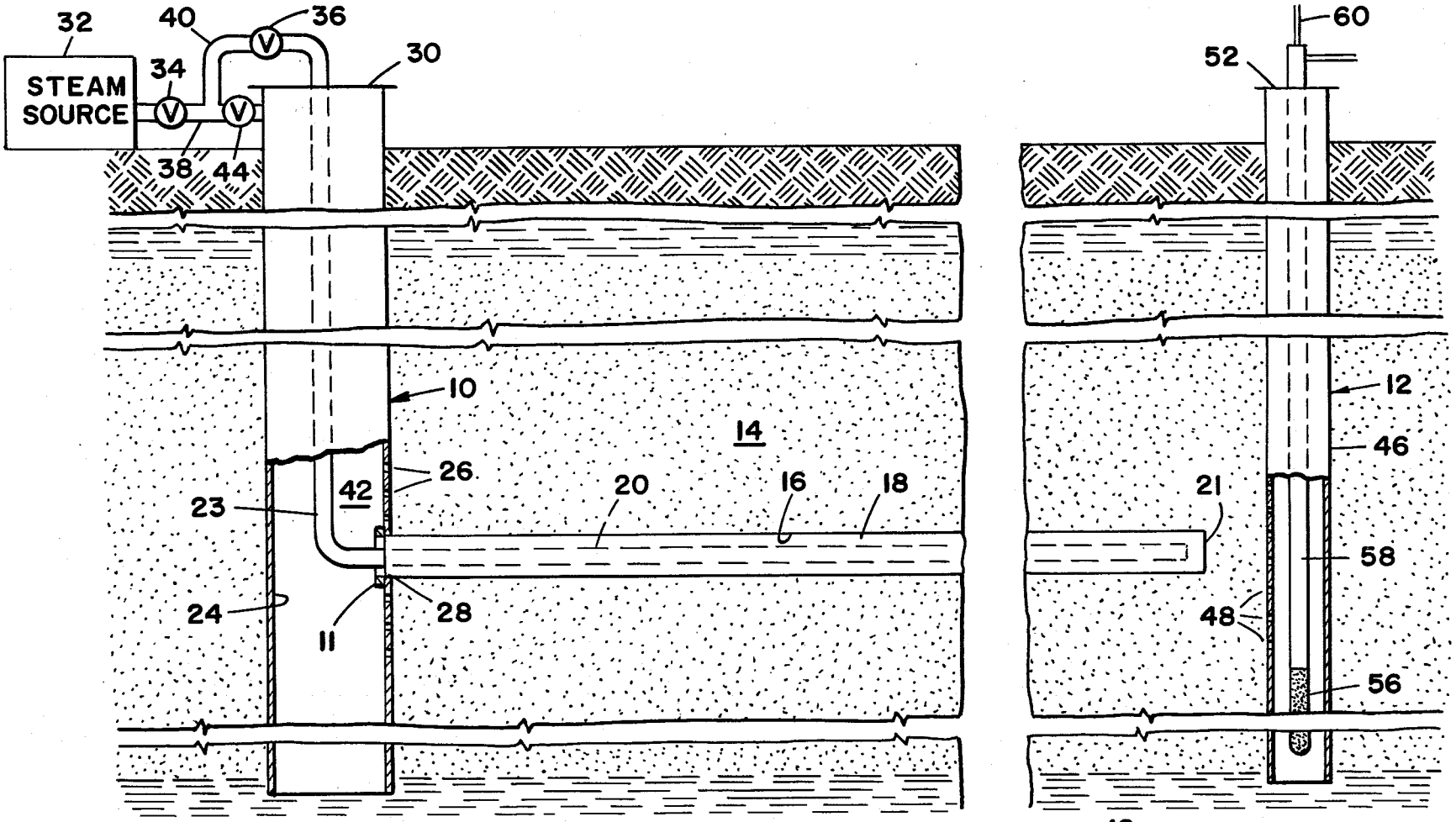
FIG 1 is an elevation view partially in section and illustrates the preferred embodiment of apparatus assembled in accordance with the present invention for use in recovering viscous petroleum from an underground formation.

Refer now to the drawing, and to FIG. 1 in particular, where the preferred embodiment of apparatus assembled in accordance with the invention is illustrated. FIG. 1 shows a substantially vertical passage or shaft and a spaced-apart well, respectively generally indicated by the numerals 10 and 12, which penetrate the earth to a viscous petroleum or tar sand formation 14. For ease in description, vertical passage 10 will be termed a shaft 10. A lateral hole 16 is extended in a substantially horizontal mode from shaft 10 and terminates in relatively close proximity to well 12. A solid-wall, hollow tubular member 18 is inserted through the hole 16. The tubular member is preferably steel and may be made up of one piece or many connecting joints. The outer end of the tubular member is closed to fluid flow by a suitable end plate 21. The inner end of the tubular member is connected to the casing 24 of the shaft 10 by a suitable flange 11. A flow pipe 20 is inserted into the tubular member 18 and terminates at a position near the closed end 21 of the tubular member. A tubing string 23 is connected to the tubular member 18 in the shaft 10 and extends to the surface. The solid-wall, tubular member 18 and the flow pipe 20 provide a continuous, uninterrupted flow path through the viscous petroleum-containing formation into and out of the shaft 10. Tubing strings 23 serves to extend the flow pipe to the surface through the shaft. If desired, a concentric pipe could be connected between the surface and tubular member 18 to carry condensate to the surface. Generally it is preferred to retain this hot fluid in the well.

The shaft 10 is cased by casing string 24. The casing is perforated or slotted, as indicated by the numeral 26. An opening 28 for the tubular member 18 is also provided in the casing. The upper end of the casing 24 is closed by a wellhead indicated schematically as 30. A steam source 32 is connected through valves 34 and 36 and suitable tubing 38 and 40 to tubing string 23 and thence to flow pipe 20 and thence to the flow pipe 20-tubular member 18 annulus. The tubing string 23-casing 24-annulus 42 is also connected to steam source 32 by means of tubing 38 through valves 34 and 44. Thus, by appropriate control of valves 34, 36 and 44, steam may be directed either simultaneously or alternatively into the flow path formed by the flow pipe 20-tubular member 18 annulus via tubing string 23 and/or into the formation 14 via tubing-casing annulus 42 and perforations 26.

The producer well 12 is cased by a suitable casing by a suitable casing string 46. The casing is slotted or perforated, as indicated by the numeral 48. The producer well 12 is located in near proximity to the flow path provided by tubular member 18 and flow pipe 20. The upper end of the casing string 46 is closed by a wellhead 52. A means for lifting pertroleum from the interior of production well 12 is provided. For example, a pump 56 is used to lift petroleum by a suitable sucker rod string 60 through a production flow path 58 to the surface.

Figure 2:
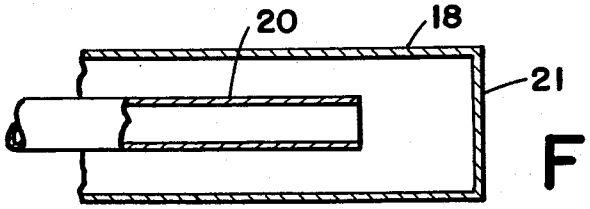
FIG. 2 is an enlarged view of a portion of the apparatus of FIG. 1.

In operation, it is usually desirable to first introduce steam into the annulus 42 of shaft 10 to attempt to obtain injection of steam into formation 14 through perforations 26. In most instances, in viscous tar sands, little or no injection is obtained. In accordance with the invention, steam is then flowed through the formation 14 but out of direct contact therewith in the flow path provided by tubing string 23, flow pipe 20 and tubular member 18 by appropriate manipulation of valves 34, 36 and 44. The steam or hot fluid flowing in this flow path heats the viscous petroleum in formation 14 to reduce the viscosity of at least a portion of the petroleum adjacent the outside of the tubular member 18. This provides a potential passage for flow of the drive fluid or steam through the formation via annulus 42 and perforations 26. By suitably controlling the flow in the flow pipe 20-tubular member 18 annulus and the formation 14, a good sweep efficiency can be obtained and oil recovery maximized at recovery well 12. Thus when the steam flowing in the flow path establishes injectivity for the drive fluid into the formation and results in some production of petroleum from the producer steam flow through the flow path is terminated to prevent breakthrough of the drive fluid. If injectivity of the drive fluid becomes undesirably low, then additional steam is flowed through the flow path to reestablish the desired injectivity. In some instances a back flush or other operation may be necessary at well 12 to initiate production. FIG. 2 is an enlarged view of the ends of the flow pipe 20 and the tubular member 18 showing the closed end 21 which provides the circulating flow path through the formation.

Figure 3:
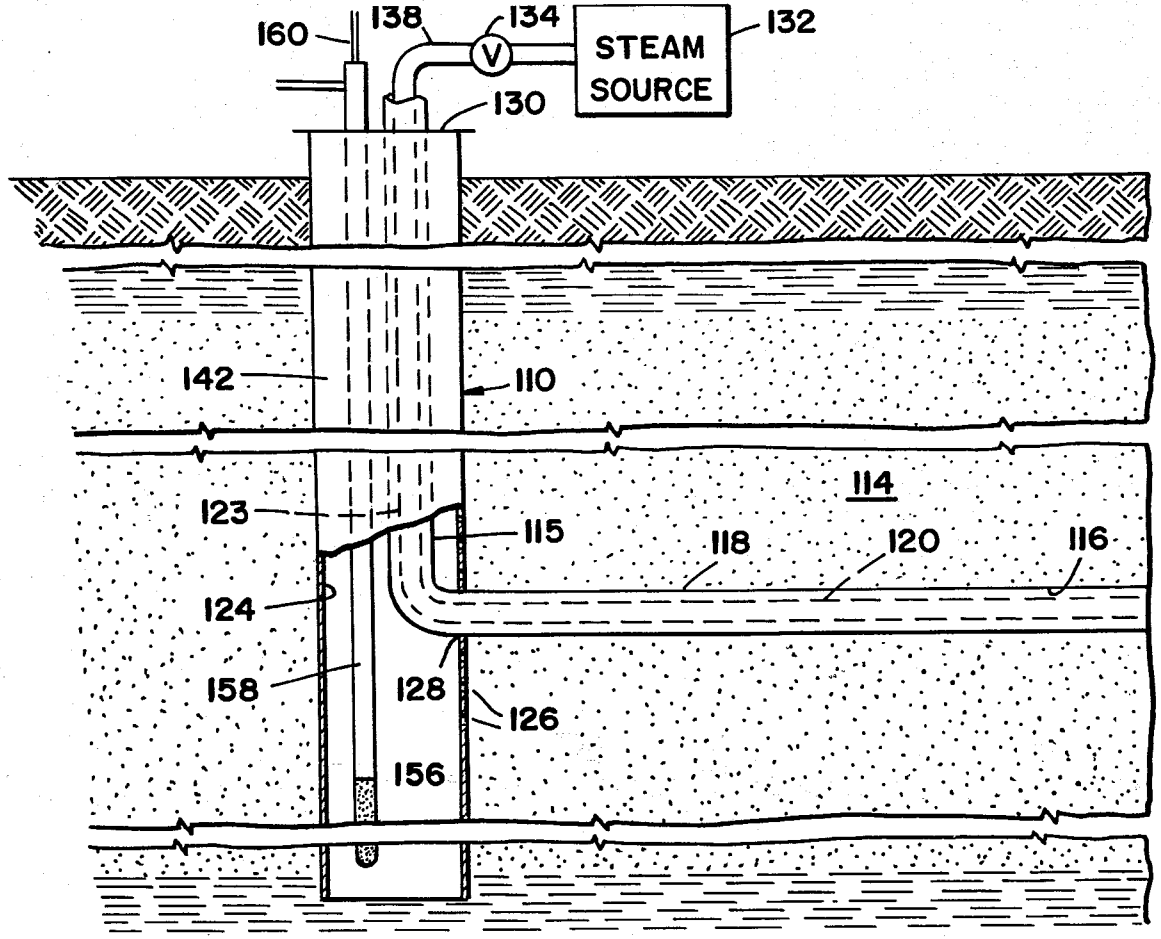
FIG. 3 is an elevation view partially in section and illustrates an alternative arrangement of apparatus assembled in accordance with the present invention.

FIG. 3 is an elevation view partially in section and illustrates an alternative arrangement of apparatus assembled in accordance with the invention. FIG. 3 shows a substantially vertical passage or shaft and a spaced-apart well, respectively generally indicated by the numerals 110 and 112, which penetrate the earth to a viscous petroleum or tar sand formation 114. For ease in description, vertical passage 110 will be termed a shaft 110. A lateral hole 116 is extended in a substantially horizontal mode from shaft 110 and terminates in relatively close proximity to well 112. A solid-wall, hollow tubular member 118 is inserted through the hole 116. The tubular member is preferably steel and may be made up of one piece or many connecting joints. The outer end of the tubular member is closed to fluid flow by a suitable end plate 121. The inner end of the tubular member is connected through a hole 128 in the casing 124 of the shaft 110 to a surface string of casing 115. A flow pipe 120 is inserted into the tubular member 118 and terminates at a position near the closed end 121 of the tubular member. A tubing string 123 is connected to the tubular member 118 in the shaft 110 and extends to the surface. The solid-wall, tubular member 118 and the flow pipe 120 provide a continuous, uninterrupted flow path through the viscous petroleum-containing formation into and out of the shaft 110. Tubing strings 123 and 115 serve to extend the flow path to the surface through the shaft. Casing string 115 could be eliminated and the condensate pumped to the surface, if desired.

The shaft 110 is cased by casing string 124. The casing is perforated or slotted, as indicated by the numeral 126. An opening 128 for the tubular member 118 is also provided in the casing. The upper end of the casing 124 is closed by a wellhead indicated schematically as 130. A steam source 132 is connected through valve 134 and suitable tubing 138 to tubing string 123 and then to flow pipe 120 and then to flow pipe 120-tubular member 118 annulus and then to the surface via the tubing 123-casing 115 annulus. A means for lifting petroleum is provided in shaft 110. A downhole pump 156 lifts liquid by a suitable sucker rod string 160 through a production flow path 158. By appropriate control of valve 134 and a valve on the return annular conduit (not shown) steam may be directed into the flow path formed by the flow pipe 120-tubular member 118 annulus to heat the viscous petroleum outside tubular member 118.

An injector well 112 is cased by a suitable casing string 146. The casing is slotted or perforated, as indicated by the numeral 148. The injector well 112 is located in near proximity to the flow path provided by tubular member 118 and flow pipe 120. A steam injection tube 145 terminates near the perforations 148 and the upper portion of the steam injection tube passes through the casing string 146 and a wellhead 152. The injection tube 145 is connected to a steam source 147 by means of conduit 151 through valve 153. Thus, steam may be injected through well 112 into the formation 114 and, in accordance with the invention, assist in moving petroleum toward shaft 110 along the outside of the tubular member 118.

In operation, it is usually desirable to first introduce steam into the injection well 112 to attempt to obtain injection of steam into formation 114 through perforations 148. In most instances, in viscous tar sands, little or no injection is obtained. In accordance with the invention, steam is then flowed through the formation 114 but out of direct contact therewith in the flow path provided by tubing string 123, flow pipe 120 and tubular member 118 by appropriate manipulation of valve 134. The steam or hot fluid flowing in this flow path heats the viscous petroleum in formation 114 to reduce the viscosity of at least a portion of the petroleum adjacent the outside of the tubular member 118. This provides a potential passage for flow of the drive fluid or steam through the formation via injector well 112 through perforations 148. By suitably controlling the flow in the flow pipe 120-tubular member 118 annulus and the formation 114, a good sweep efficiency can be obtained an oil recovery maximized at recovery shaft 110.

Figure 4:
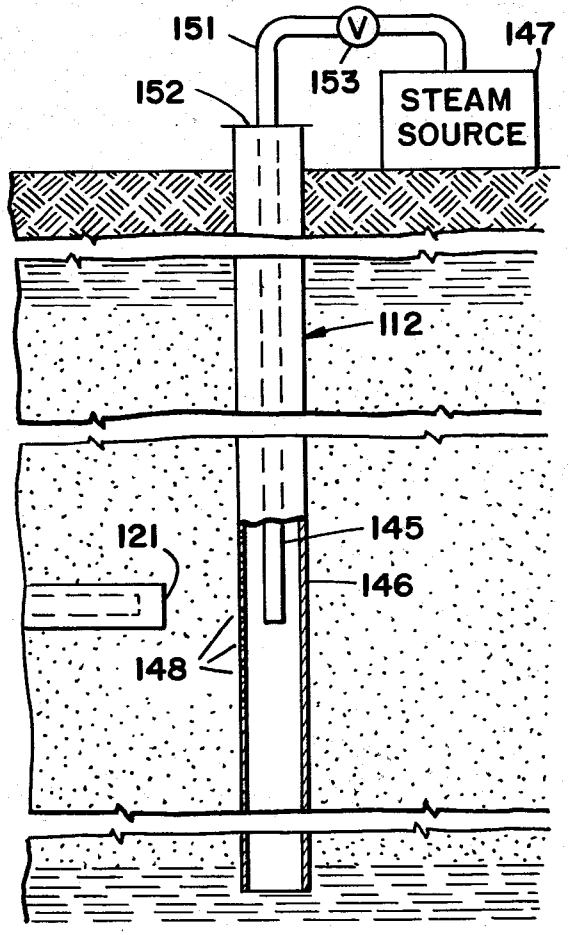
FIG. 4 is a plan view and illustrates a potential well layout in accordance with the present invention.
Figure 4:
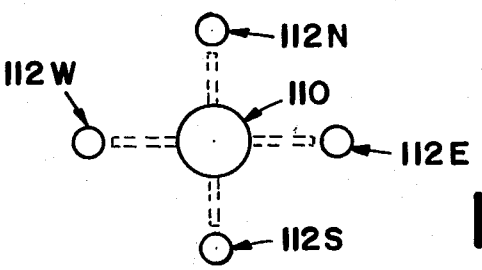

FIG. 4 is a plan view of a potential field layout using a central producer shaft and a plurality of spaced-apart injector wells. The plan view of FIG. 4 could, for example, be utilized with the well arrangement shown in elevation in FIG. 3. Thus a central producer well indicated generally by 110 is seen intermediate of spaced-apart injector wells indicated generally by the numerals 112E (east), 112N (north), 112W (west) and 112S (south). The arrangement illustrated in FIG. 4 provides a useful layout in field operations.

FIG. 5 is an elevation view partially in section and illustrates apparatus used in conducting demonstrations in accordance with the present invention. As there shown, a sand pack 70 of Athabasca tar sand was encased in a suitable elongated core tube 72. The core tube was provided with suitable end plates 74 and 76 for receiving a hollow tubular member 78. The apparatus is also arranged for steam injection into the face of the sand pack through conduit 80 and for collecting proceeds of the sand pack flood through conduit 82. A steam source 84 is connected to the tubular member 78 and to the sand pack face through tubing 86 and control valve 88. A down-stream control valve 90 controls flow of steam through the central tubular member 78. Thus, assisted recovery operations in accordance with the invention can be demonstrated utilizing the apparatus shown in FIG. 5.

FIG. 6 is a perspective of a block of Athabasca tar sand showing a number of core positions for cores taken longitudinally through the core block. The cores are identified by number and flow plane as indicated. The tar sand block was flooded in accordance with the method of the invention. The cores were taken after the flood and analyzed for residual petroleum. Stration apparatus similar to that shown in FIG. 5. FIG. 7 is a table indicating the residual viscous petroleum weight by core position and plane of the cores of FIG. 6. The original block contained 13.5% by weight of viscous petroleum. As is evident from the table of FIG. 7, a substantail weight percent of a viscous petroleum was recovered when the block was flooded in accordance with the method of the present invention.

Further with respect to FIGS. 5, 6 and 7, in order to demonstrate the method of the present invention, it was necessary as a first step to set up an apparatus containing Athabasca oil sand having a zero effective permeability to steam. To do this, a 1 inch-ID by 12 inches-long quartz tube was used. The tube was packed with Athabasca oil sand containing about 13% weight viscous petroleum and about 4% water. Fittings were attached to both ends of the tube and a conventional steam drive applied to the oil sand at a pressure of 75 psi and a temperature of 320° F. It was found during the early runs that 50% of the petroleum was recovered because of unrealistic permeability to steam, and so the runs did not successfully simulate Athabasca conditions. It was found later that by using a ½ inch-diameter solid steel rod, 12 inches long, as a tool for ramming the oil sand very tightly in the tube, the room temperature air permeabilities were reduced to less than 50 millidarcies, a much more realistic value for viscous petroleum-containing formations. In this region of permeability, conventional steam drive did not work and the steam front advanced only about 1 inch into the tube and no farther, since the initally mobilized petroleum blocked off any communication, thereby reducing the effective mobility to zero. These conditions were reproducible on a satisfactory basis.

The method of the invention was then demonstrated using the apparatus shown schematically in FIG. 5. FIG. 5 shows a partially completed demonstration in accordance with the method of the invention. The in-place tubular member 78 has been heated by opening the heating annulus control valve 90 allowing steam to pass through. This immediately provides steam injectivity at the drive end of the tar sand pack 70 and viscous petroleum produced immediately at the producing end. Recoveries in these experiments ranged from 48 to 52% weight of the total petroleum in place. Residual petroleum was determined in every case by exhaustive solvent extraction at the end of each run. In some demonstrations, too much heat was allowed to pass through the tubular member 78, thereby creating an annulus outside the tubular member of very high mobility, allowing premature steam breakthrough and giving rather poorer recoveries, on the order of only 30% of the total petroleum in place.

In order to demonstrate the present method in a laboratory under more realistic field-type conditions, the demonstrations were modified by using large chunks of relatively undistributed Athabasca oil sand. These ranged in weight from one to about four kilograms and appeared to be devoid of cracks. They were randomly shaped and generally roundish or oval. These were encased in epoxy resin so that a total thickness of about 4 inches existed all around the oil sand piece. The placement of the inplace tubular member and injector and producer were very similar to the apparatus shown in FIG. 5. Again, a ⅛ inch stainless-steel tube was used for the in-place tubular member. In order to establish that there was indeed zero effective mobility, a steam drive was always applied to the injector before allowing any heat to pass through the in-place tubular member. Three experiments were run, and in no case was there more than four drops of water produced at the exit from the block, and this slight water production ceased after less than one minute after initiating conventional steam drive. After reaching this static condition with zero injectivity, the heated annulus control valve 90 was cracked slightly, allowing passing of steam into the tubular member 78. Immediately petroleum flowed from the producer end of the core at a high petroleum/water ratio. Care must be exercised in controlling the amount of heat through the in-place tubular member since, in one case, this was not done and the over-all recovery was 30% of the total petroleum in place. Even continued flowing of steam through the block between injector and producer did not allow any further recovery of petroleum in this instance. On breaking open the block, it was found that a very clean oil sand of higher permeability had been created as an annulus close to the in-place pipe. Since the heat in the tubular member was not controlled, good sweep efficiency of the block was not obtained in this case.

The most successful demonstration run was that carried out on a 3.5-kg block of oil sand, initially 13.5% weight petroleum content. Total recovery was 65% of the petroleum originally in place. In all of these experiments, the same pressure and temperature of 75 psi and 320°F respectively were used.

Although, at first glance, the practice of the invention might lead one to expect a very low residual oil content close to the annulus surrounding the in-place tubular member and a high residual oil resulting from poor sweep efficiency in those regions of the sample farthest away from the in-place pipe, this was not the case. In fact, excellent sweep efficiency is obtained when the ratio of hot fluid to drive fluid is controlled so as not to permit early steam breakthrough. In order to evaluate this concern, the encased 3.5-kg block of oil sand at the end of a demonstration was cut through the center at right angles to the in-place tubular member. The oil sand was then cored using a ¾ inch-diameter core borer and sampled to a depth of ½ inch. This was done at 11 locations in each of 6 different planes in the oil sand block. A diagram of the location of these core samples is shown in FIG. 6. A total of 66 samples was taken and each analyzed for residual petroleum content by exhaustive extraction with toluene. The results are shown in FIG. 7. It can be seen that a remarkably uniform sweep of the oil sand sample had taken place. Particularly surprising is the fact that the residual petroleum in those 6 cores taken from the annulus immediately surrounding the in-place tubular member show a residual petroleum content not too different from the cores farthest away from the in-place tubular member.

The demonstrations show that the method of the present invention satisfactorily simulated the zero effective mobility of the Athabasca oil sand deposit. The recovery demonstrations showd that a communication path between injector and producer can be successfully developed; and provided excessive heating of the in-place tubular member is avoided, recoveries up to 65% of the petroleum in place can be achieved. The sweep efficiency is surprisingly high, resulting in an even distribution of residual oil. This means that the reservoir after an assisted-recovery operation conducted in accordance with the invention would be amendable to further recovery techniques such as combustion, chemical floods, etc. Particularly attractive is the fact that injecting drive fluids would be confined to the area of interest between injector and producer, since this would be the only pathway open to them. In other words, it is unlikely that the fluids would be lost to the other parts of the reservoir because of the relative impermeability of the formation on the outer edge of the swept area.

What is claimed is:

1. A method of recovering viscous petroleum from a petroleum-containing formation comprising providing a substantially vertical passage from the earth's surface through said formation, extending at least one lateral hole from said vertical passage through at least a portion of said formation, forming a flow path in said hole isolated form said formation for flow of fluid through said formation into and out of said vertical passage, circulating a hot fluid through said flow path to reduce the viscosity of the viscous petroleum in said formation adjacent the outside of said flow path to form a potential passageway for flow of petroleum in said formation outside of said flow path and injecting a drive fluid into said formation through said passageway to promote flow of petroleum in said formation to a recovery position for recovery from said formation.

2. The method of claim 1 where the hot fluid is steam.

3. The method of claim 2 where the drive fluid is steam.

4. The method of claim 1 wherein said hot fluid and said drive fluid are injected simultaneously.

5. The method of claim 1 wherein said hot fluid and said drive fluid are injected intermittently.

6. The method of claim 1 wherein injectively of said drive fluid into said formation is controlled by adjusting the flow of hot fluid through said flow path.

7. The method of claim 1 where said recovery position is a well penetrating said petroleum-containing formation in close proximity to said flow path and said drive fluid is injected into said formation through said vertical passage.

8. The method of claim 1 where said recovery position is located in said vertical passage and said drive fluid is injected into said formation through a well penetrating said petroleum-containing formation in close proximity to said flow path.

9. A method for recovering viscous petroleum from a petroleum-containing formation of the Athabasca type comprising providing a substantially vertical passage from the earth's surface through said formation, extending at least one lateral hole from said vertical passage through at least a portion of said formation, inserting a solid-wall, hollow tubular member having a closed outer end into said horizontal hole, inserting a flow pipe into said hollow tubular member to a position near the closed end of said tubular member to provide a flow path from said vertical passage through said horizontal hole into and out of said formation through the interior of said flow pipe and the space between the exterior of said flow pipe and the interior of said tubular member, circulating a hot fluid through said flow path to reduce the viscosity of the viscous petroleum in said formation adjacent the outside of said tubular member to form a potential passageway for flow of petroleum in said formation outside of said tubular member, and forcing a drive fluid into said formation through said passageway to promote flow of petroleum adjacent the outside of said tubular member to a position for recovery from said formation.

10. The method of claim 9 where the hot fluid is steam.

11. The method of claim 10 where the drive fluid is steam.

12. The method of claim 11 wherein said hot fluid and said drive fluid are injected simultaneously.

13. The method of claim 9 wherein said hot fluid and said drive fluid are injected intermittently.

14. The method of claim 9 wherein injectivity of said drive fluid into said formation is controlled by adjusting the flow of hot fluid through said flow path.

15. The method of claim 9 where said recovery position is a well penetrating the petroleum-containing formation near the closed end of said tubular member and said drive fluid is injected into said formation through said vertical passage.

16. The method of claim 9 where said recovery position is located in said vertical passage and said drive fluid is injected into said formation through a well penetrating the petroleum-containing formation near the closed end of said tubular member.

* * * * *